US007805236B2

(12) United States Patent
Mullen

(10) Patent No.: US 7,805,236 B2
(45) Date of Patent: Sep. 28, 2010

(54) APPARATUS AND METHOD FOR ADJUSTING THE PERFORMANCE OF AN INTERNAL COMBUSTION ENGINE

(76) Inventor: Stephen Mullen, 415 Arrowhead Ct., Oldsmar, FL (US) 34677

( * ) Notice: Subject to any disclaimer, the term of this patent is extended or adjusted under 35 U.S.C. 154(b) by 92 days.

(21) Appl. No.: 12/200,248

(22) Filed: Aug. 28, 2008

(65) Prior Publication Data

US 2009/0192694 A1 Jul. 30, 2009

Related U.S. Application Data

(60) Provisional application No. 61/024,697, filed on Jan. 30, 2008.

(51) Int. Cl.
*F02D 41/00* (2006.01)
*F02D 41/14* (2006.01)

(52) U.S. Cl. ..... 701/103; 123/694; 123/695; 123/696

(58) Field of Classification Search ..... 701/103, 701/109, 102; 123/672, 703, 693, 694, 695, 123/696; 60/276
See application file for complete search history.

(56) References Cited

U.S. PATENT DOCUMENTS 3,903,853 A 9/1975 Kizler et al.
4,120,270 A 10/1978 Asano et al.
4,167,925 A 9/1979 Hosaka et al.
4,182,292 A 1/1980 Anzai et al.
4,226,221 A * 10/1980 Asano ..... 123/687
4,378,773 A * 4/1983 Ohgami ..... 123/694
4,479,646 A 10/1984 Kondo et al.
4,503,828 A * 3/1985 Ohgami et al. ..... 123/694
5,033,438 A 7/1991 Feldinger et al.
5,396,875 A * 3/1995 Kotwicki et al. ..... 123/681
6,260,547 B1 7/2001 Spencer-Smith
6,279,372 B1 8/2001 Zhang
6,668,617 B2 12/2003 Radu et al.
6,837,233 B1 1/2005 Spencer-Smith
6,904,355 B2 6/2005 Yasui et al.

* cited by examiner

*Primary Examiner*—Mahmoud Gimie
(74) *Attorney, Agent, or Firm*—Maxey Law Offices, PLLC; Stephen Lewellyn

(57) ABSTRACT

A passive control device is interposable between an oxygen sensor and an electric control unit of a motor vehicle to modify a reference voltage used by the electric control unit so that a richer fuel mixture is provided to an internal combustion engine of the motor vehicle than would otherwise be provided in absence of the passive control device. The passive control device directly passes the voltage signal from the oxygen sensor to the electronic control unit without modification. The passive control device works with the electronic control unit to provide a richer fuel mixture without reprogramming the electronic control unit.

14 Claims, 5 Drawing Sheets

APPARATUS AND METHOD FOR ADJUSTING THE PERFORMANCE OF AN INTERNAL COMBUSTION ENGINE

CROSS-REFERENCE TO RELATED APPLICATIONS

This application claims the benefit of U.S. Provisional Application No. 61/024,697, filed Jan. 29, 2008, the entire of which is incorporated herein by reference.

FIELD OF THE INVENTION

The present invention relates generally to the closed-loop air/fuel control of an internal combustion engine. More particularly, to the modification of the closed-loop air/fuel control without modifying the programming of an electronic control unit (ECU) used to control the internal combustion engine.

BACKGROUND OF THE INVENTION

Most modern internal combustion engines utilize a form of electronic fuel-injection (EFI) system to control the air/fuel ratio (AFR) of the combustion mixture. The EFI system works to control the air/fuel ratio under all operating conditions to achieve the desired engine performance, emissions, driveability, and fuel economy. EFI systems use a programmed electronic control unit (ECU) or module (ECM) to monitor engine operating conditions and control fuel injection to increase or decrease the air/fuel ratio depending on the engine operating conditions. The ECU operates either in an open-loop controlled fuel injection with predetermined fuel maps, or in a closed-loop feedback-controlled fuel injection. Closed-loop feedback-controlled fuel injection varies the fuel injector output according to real-time sensor data rather than operating with the predetermined (open-loop) fuel map. Real-time sensor data from an oxygen sensor (or "$O_2$ sensor") is used to measure the proportion of oxygen ($O_2$) in the exhaust gas. The oxygen sensor generates an electrical voltage indicating the amount of oxygen measured in the exhaust gas. The oxygen sensor generates a voltage in the range of about 0 to 1 volts. Higher voltages (greater than 0.5 volts) means there is less oxygen in the exhaust and indicates a rich mixture. Lower voltages (less than 0.5 volts) means there is more oxygen in the exhaust and indicates a lean mixture. The ECU reads the oxygen sensor voltage signal and produces fuel injector control signals to operate the fuel injectors to either richen the fuel mixture or to lean the fuel mixture.

For gasoline fuel burning engines, manufactures typically preprogram the ECU to control the fuel injectors to maintain a stoichiometric AFR of 14.7:1 for the majority of engine operating conditions. Any mixture less than 14.7:1 is considered to be a rich mixture, any more than 14.7:1 is a lean mixture. Most oxygen sensors are manufactured to generate a voltage of 0.5 volts when the AFR is 14.7:1.

It is known to modify an existing ECU to adjust the performance of the internal combustion engine. Heretofore, modifying an existing ECU has required reprogramming the programmable eprom or computer chip, replacing the eprom with another eprom having a different program, or piggy backing the ECU with another controller that operates to intercept signals, modify the intercepted signals and then pass the modified signal to various engine operating components to achieve the desired engine performance.

Various problems can arise when an existing ECU is modified as indicated above. The physically changed or new eprom must be to manufacture's application, and during use may cause knocking, drivability issues both at idle and wide open throttle, lean misfires, detonation, signaling of trouble codes in vehicles equipped with on-board diagnostic (OBD), void manufacture's warranties, and require physical modification of the engine's electrical wiring harness.

Accordingly, there is a need for an apparatus and method that can be employed to modify the performance of internal combustion, and specifically, the air/fuel ratio of an internal combustion engine that overcomes the drawbacks of the prior art.

SUMMARY OF THE INVENTION

The preferred embodiments of the present invention addresses this need by providing a passive control device that is interposable between an exhaust gas sensor, such as an oxygen sensor, and the electronic control unit (ECU) to modify the air/fuel ratio without reprogramming the ECU. The device operates to pass through the oxygen sensor voltage signal to the ECU without modification to the voltage signal, and to modify a reference voltage used by the ECU in determining the value of the voltage signal.

To achieve these and other advantages, in general, in one aspect, an apparatus for modifying the performance of an internal combustion engine of a motor vehicle including fuel injectors, an oxygen sensor for sensing the amount of oxygen in the exhaust gas produced by the internal combustion engine, and a preprogrammed electronic control unit for receiving a voltage signal from the oxygen sensor, and in response thereto producing fuel injector control signals controlling the operation of the fuel injectors, is provided. The apparatus includes a voltage modifying means for proportionally modifying a reference voltage as a function of the voltage signal of the oxygen sensor to modify the fuel injector control signals produced by the electronic control unit without modifying the programming of the electronic control unit, and the voltage modifying means being interposable between the oxygen sensor and the electronic control unit.

In general, in another aspect, the voltage modifying means modifies the reference voltage to cause the electronic control unit to produce fuel injector control signals that provide a richer fuel mixture to the internal combustion engine than what would be provided in the absence of the voltage modifying means.

In general, in another aspect, the voltage modifying means passes through the voltage signal of the oxygen sensor to the electronic control unit without modification of the voltage signal.

In general, in another aspect, the voltage modifying means includes a resistor circuit which passes through the voltage signal of the oxygen sensor to the electronic control unit without modification to the voltage signal, and divides the voltage signal of the oxygen sensor based upon the resistance values of a resistor pair and adds the divided voltage to the reference voltage.

In general, in another aspect, a method for adjusting the performance of an internal combustion engine of a motor vehicle including fuel injectors, an oxygen sensor for sensing the amount of oxygen in the exhaust gas produced by the internal combustion engine, and a preprogrammed electronic control unit for receiving a voltage signal from the oxygen sensor, and in response thereto producing fuel injector control signals controlling the operation of the fuel injectors is provided. The method includes the steps of:

(a) interposing a voltage modifying means between the oxygen sensor and the preprogrammed electronic control unit;

(b) passing voltage signals from the oxygen sensor to the preprogrammed electronic control unit without modification to the voltage signals;

(c) proportionally modifying a reference voltage with the voltage modifying means as a function of the passed voltage signals from the oxygen sensor to produce a modified reference voltage;

(d) generating modified fuel injector control signals as a function of the modified reference voltage without changing the programming of the preprogrammed electronic control unit; and (e) employing the modified fuel injector control signals to cause the fuel injectors to provide a richer fuel mixture to the internal combustion engine than would be provided in the absence of the step of modifying the reference voltage.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The accompanying drawings, which are included to provide further understanding of the invention and are incorporated in and constitute a part of this specification, illustrate preferred embodiments of the invention and together with the description serve to explain the principles of the invention, in which.

DETAILED DESCRIPTION OF THE INVENTION

Reference will now be made in detail to the preferred embodiments of the present invention, examples of which are illustrated in the accompanying drawings.

Figure 1:
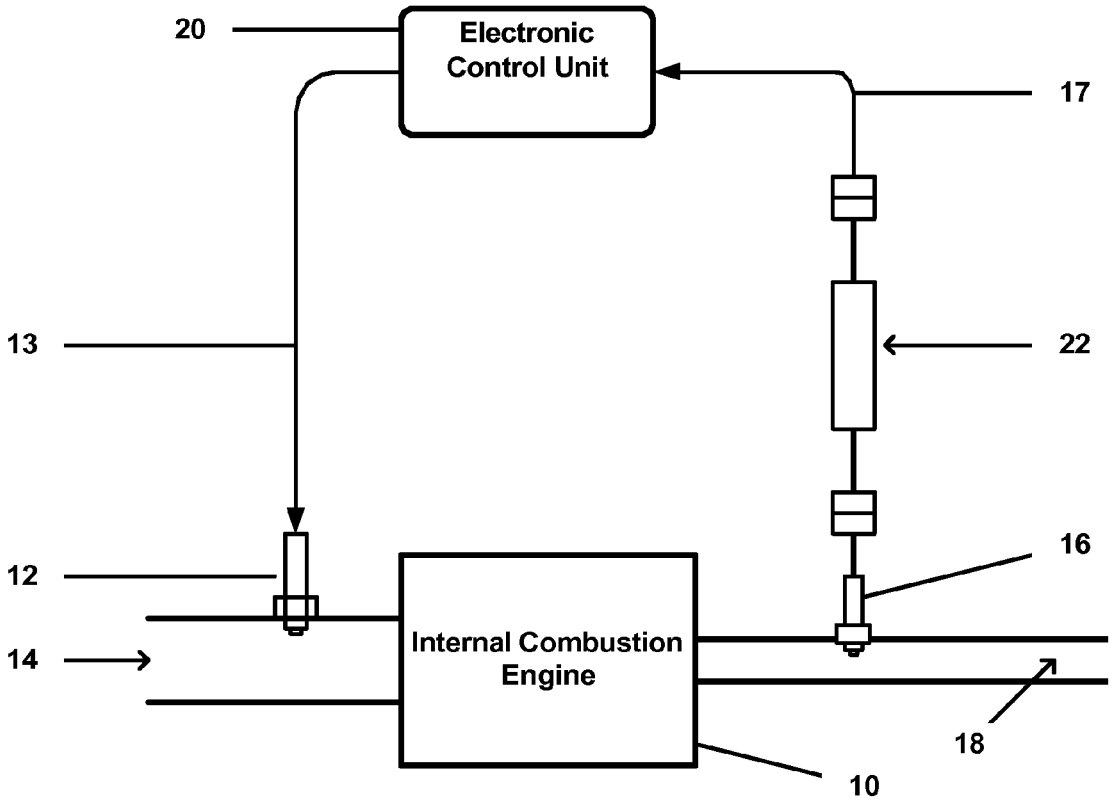
FIG. 1 is a diagrammatic view of an internal combustion engine and exhaust system having an exhaust sensor, ECU and a passive control device of the present invention operatively associated therewith.

In FIG. 1 there is shown conventional motor vehicle internal combustion engine 10 having one or more fuel injectors 12 arranged in an air intake passage 14, an exhaust gas sensor 16, such as an oxygen sensor, arranged in an exhaust passage or pipe 18. The oxygen sensor 16 of a conventional construction is employed for sensing the amount of oxygen in the exhaust passing through the exhaust pipe 18. An electronic control unit (ECU) 20 is operatively coupled to the fuel injectors 12, and is operatively coupled to the oxygen sensor 16 to receive voltage signals 17 therefrom. The ECU 20, in response to voltage signals from the oxygen sensor 16, produces fuel injector control signals 13 controlling the operation of the fuel injectors 12, in accordance with the preprogramming of the ECU. A control device 22 in accordance with the present invention is shown interposed between the oxygen sensor 16 and the ECU 20.

Figure 2:
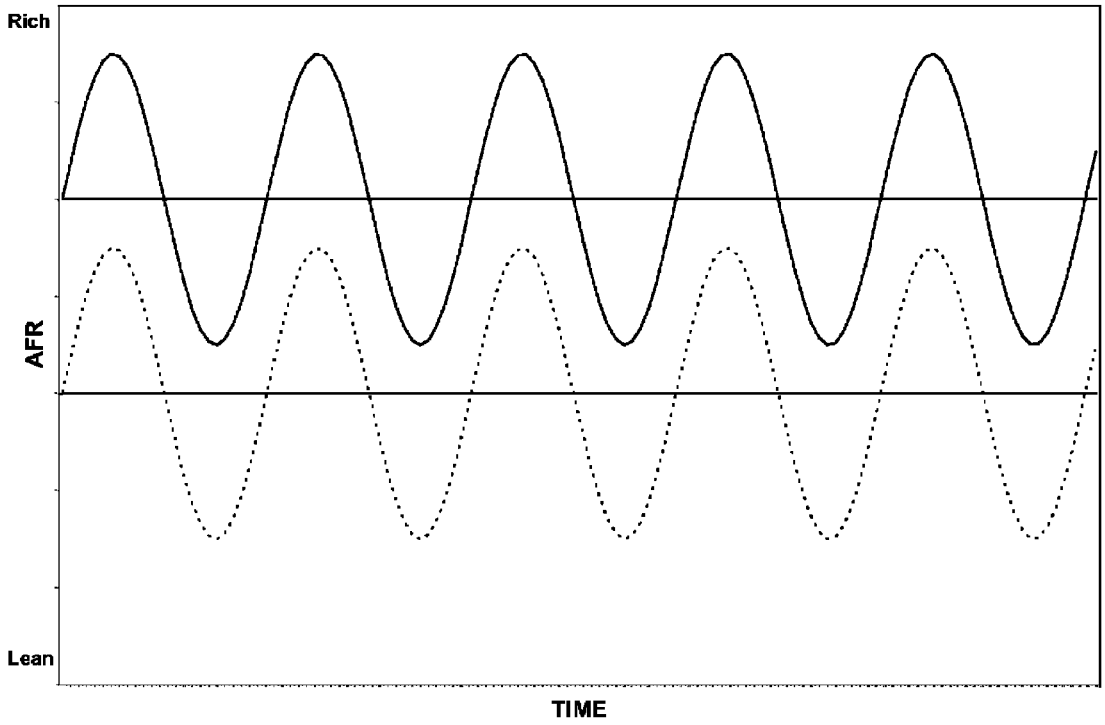
FIG. 2 is a representative oscilloscope display illustrating both a non-modified wave form of a voltage signal of an oxygen sensor as seen by a ECU (shown in solid line), and a modified wave form of the same voltage signal as seen by the ECU (shown in dashed line)

With reference to FIG. 2, there is depicted an oscilloscope display with a typical oxygen sensor voltage wave form being shown in solid lines. With reference to this, it should be noted that fuel injectors operate in a pulsed manner to inject fuel for combustion. The air/fuel pulses resulting from the associated electronic control unit would have the same wave form. The upper and lower portions of the normal wave form are substantially of the same magnitude and are respectively in a rich zone and a lean zone on opposed sides of a pre-determined stoichiometric line representing a set stoichiometric air/fuel ratio (AFR). That is, in a conventional arrangement the pulse portions fall generally evenly in the rich and lean zones so that the desired overall average stoichiometric value, in this instance 14.7:1, is attained or closely approximated.

The control device 22 operates to artificially shift the oxygen sensor voltage wave form as shown in dotted line by modifying a reference voltage that the ECU 20 measures in taking readings of the voltage signal 17 of the oxygen sensor 16. The reference voltage is modify in proportion to the voltage signal 17. In effect, with the control device 22, the ECU 20 interprets the voltage signal 17 as indicating a more lean condition than what really exists, and in turn compensates for this by producing fuel injector control signals 13 that provide a richer fuel mixture to the internal combustion engine.

Figure 3A:
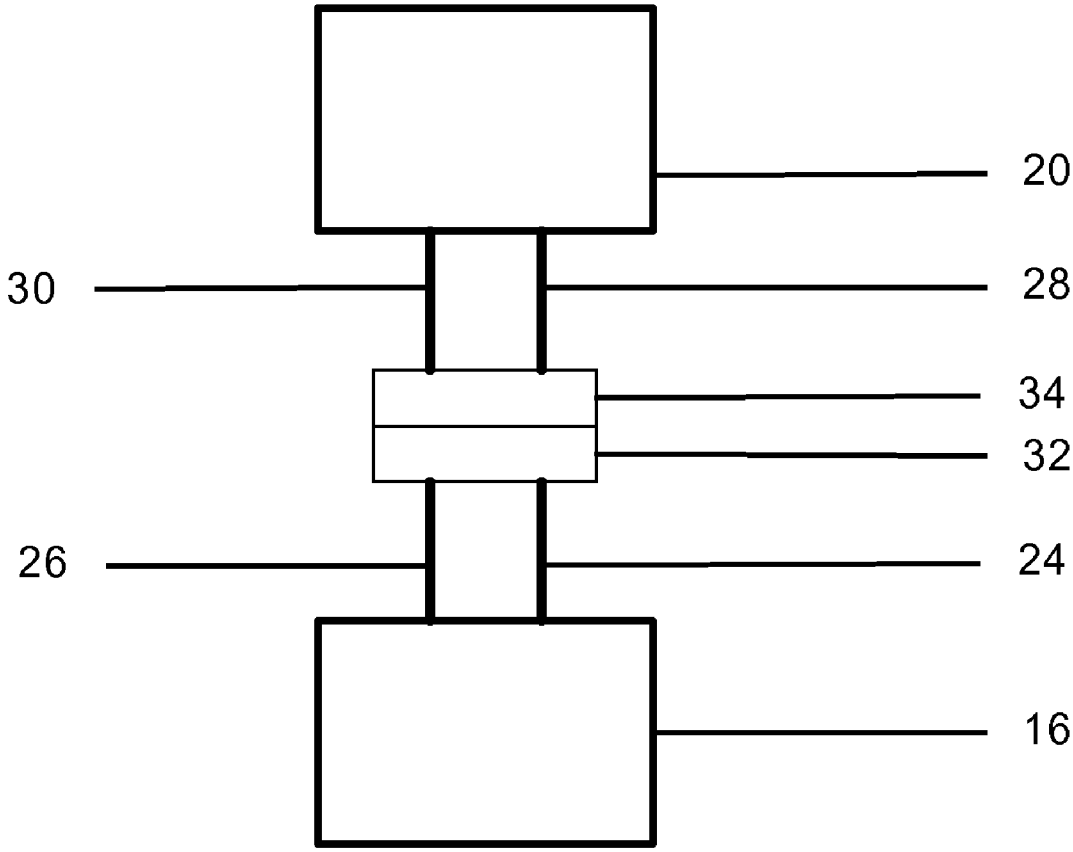
FIG. 3*a* is a diagrammatic view of an ECU connected to an oxygen sensor without the control device of the present invention.

With reference to FIG. 3*a*, there is illustrated a schematic diagram of the oxygen sensor 16, and the ECU 20 without the control device 22. The oxygen sensor 16 is a typical two-lead type having a voltage signal lead 24, and a signal ground lead 26. The ECU 20 has a voltage signal input 28 and a signal ground input 30. The voltage signal lead 24, and the signal ground lead 26 are connected to the voltage signal input 28 and signal ground input 30, respectively through a pair cooperating connectors 32, 34. The ECU 20 measures the voltage potential between the voltage signal lead 24 and the signal ground lead 26 to determine the amplitude of the voltage output by the oxygen sensor 16. In essence, the voltage on the signal ground lead 26 is used as a reference voltage in determining the voltage output by the oxygen sensor 16. Conventionally, this reference voltage would be 0 volts.

Figure 3B:
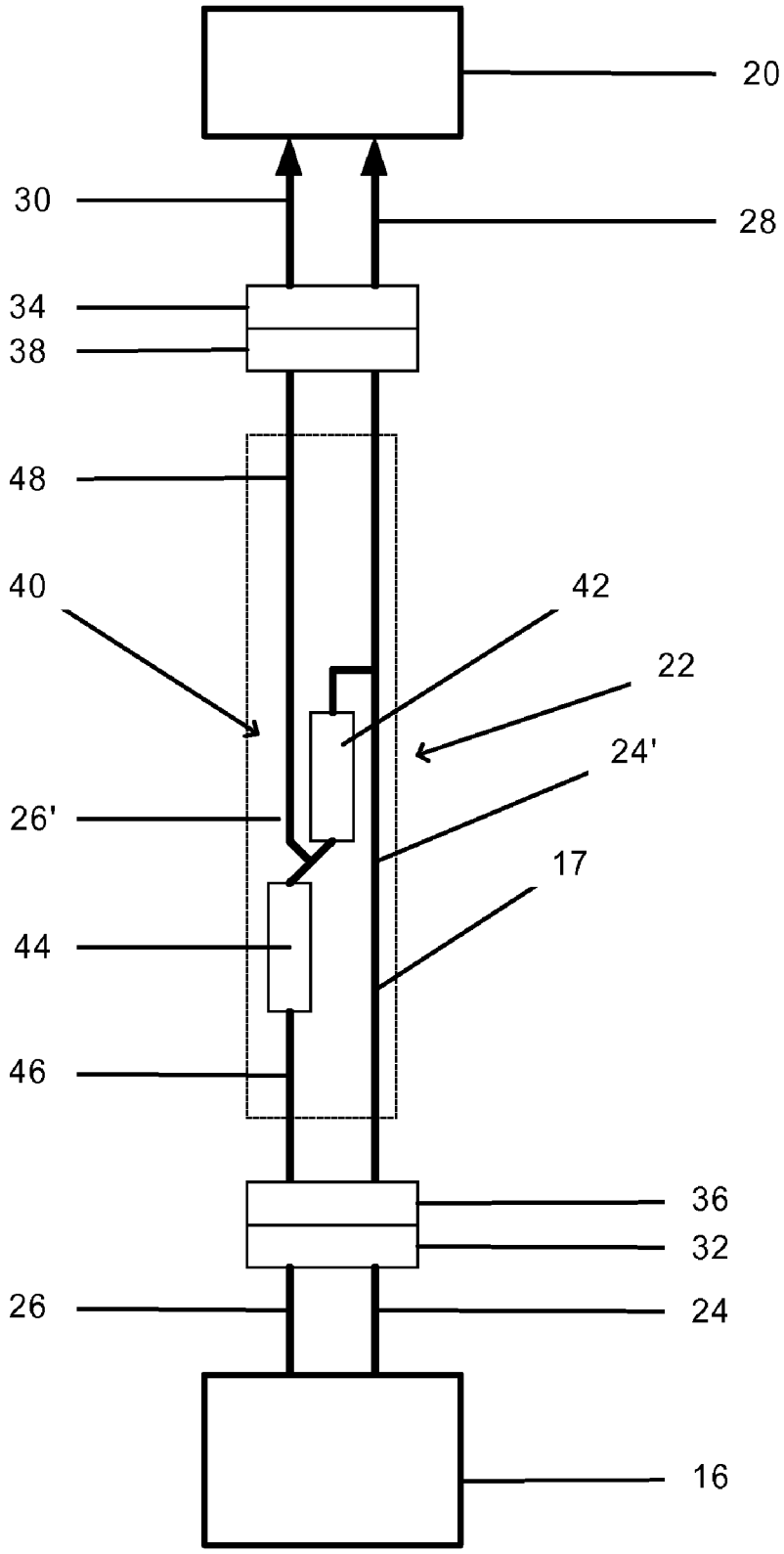
FIG. 3*b* is the view of FIG. 3*a* with the control device of the present invention interposed the oxygen sensor and ECU.

Now with reference to FIG. 3*b*, there is illustrated the same schematic diagram as FIG. 3*a* with the control device 22 removable interposed between the oxygen sensor 16 and the ECU 20. The control device 22 is detachably connected to the oxygen sensor 16 by connectors 32, 36, and is detachably connected to the ECU 20 by connectors 34, 38. The control device 22 includes a voltage signal lead 24' and a signal ground lead 26'. The voltage signal lead 24' interconnects the voltage signal lead 24 of the oxygen sensor 16 to the voltage signal input 28 of the ECU 20. The signal ground lead 26' interconnects the signal ground lead 26 of the oxygen sensor 16 to the signal ground input 30 of the ECU 20. The voltage signal 17 is passed through from the oxygen sensor 16 to the ECU without modification to the voltage signal. The control device 22 further includes a voltage modifying means 40 that interconnects the voltage signal lead 24' and the signal ground lead 26'. The voltage modifying means 40 proportionally modifies the reference voltage as a function of the voltage signal 17 of the oxygen sensor 16 to modify the fuel injector control signals 13 produced by the ECU 20 without modifying the programming of the ECU. The voltage modifying means 40 receives the voltage signal 17 as it is passed through, and operates to modify the reference voltage by adding a portion of the voltage signal 17 to the reference voltage.

The voltage modifying means 40 includes a resistor circuit having a pair resistors 42 and 44 connected together in series with resistor 42 connected to the voltage signal lead 24' and resistor 44 connected to a first portion 46 of the ground signal lead 24'. A second portion 48 of the signal ground lead 24' is connected at one end intermediate resistors 42 and 44, and is connectable at the other end to the ground signal input 30 of the ECU 20 through connectors 34, 38. In this manner, the voltage signal 17 is divided across resistors 42 and 44 proportional to the resistance value of each resistor and is added to the reference voltage as the signal ground input 30. While resistors 42 and 44 are illustrated as fixed resistance resistors, both resistor or either resistor could be replaced with a variable resistance resistor.

The resistance values of resistors 42 and 44 may be selected such that approximately a ratio of 0.4:1 of the voltage signal 17 is added to the reference voltage. The resistance values of resistors 42 and 44 may be selected such that approximately a ratio of 0.37:1 of the voltage signal 17 is added to the reference voltage. The resistance values of resistors 42 and 44 may be selected such that approximately a ratio of 0.34:1 of the voltage signal 17 is added to the reference voltage. The resistance values of resistors 42 and 44 may be selected such that approximately a ratio of 0.29:1 of the voltage signal 17 is added to the reference voltage. The resistance values of resistors 42 and 44 may be selected such that no less than a ratio of 0.34:1 of the voltage signal 17 is added to the reference voltage. The resistance values of resistors 42 and 44 may be selected such that no more than a ratio of 0.29:1 of the voltage signal 17 is added to the reference voltage.

The resistance values of resistors 42 and 44 may be selected such that resistor 42 has a resistance of 20,000 ohms, and resistor 44 has a resistance of 8,000 ohms. The resistance values of resistors 42 and 44 may be selected such that resistor 42 has a resistance of 20,000 ohms, and resistor 44 has a resistance of 10,000 ohms. The resistance values of resistors 42 and 44 may be selected such that resistor 42 has a resistance of 20,000 ohms, and resistor 44 has a resistance of 11,500 ohms. The resistance values of resistors 42 and 44 may be selected such that resistor 42 has a resistance of 20,000 ohms, and resistor 44 has a resistance of 13,000 ohms.

Figure 4:
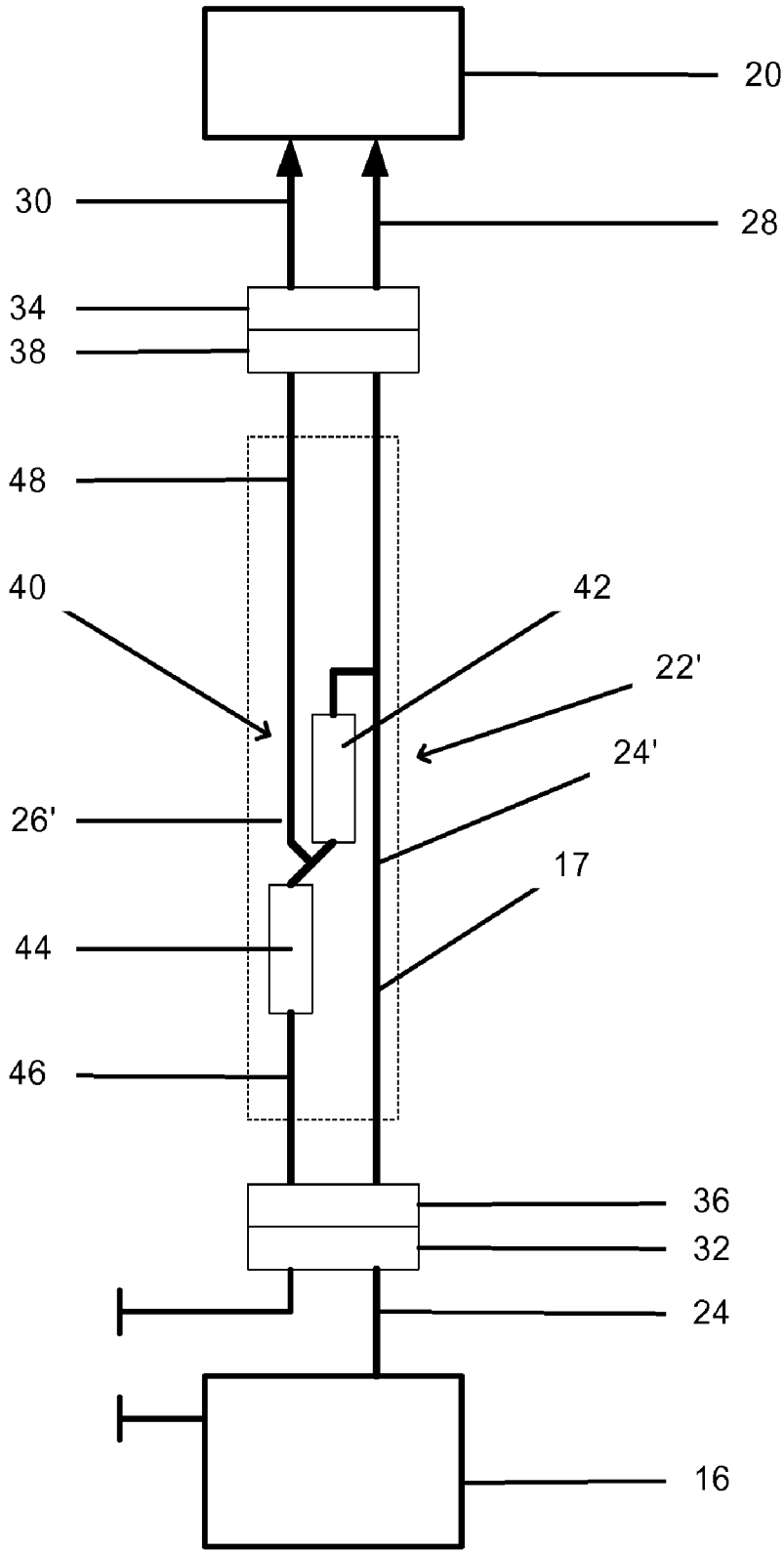
FIG. 4 is a diagrammatic view of an alternate configuration of the control device of the present invention.

In FIG. 4, there is shown an alternate configuration of the control device 22 where the oxygen sensor 16 is of the single wire type. In this configuration, the control device 22' and the oxygen sensor 16 have independent grounds with the remaining elements the same as discussed above.

A number of embodiments of the present invention have been described. Nevertheless, it will be understood that various modifications may be made without departing from the spirit and scope of the invention. Accordingly, other embodiments are within the scope of the following claims.

What is claimed is:

1. An apparatus for modifying the performance of an internal combustion engine of a motor vehicle including fuel injectors, an oxygen sensor for sensing the amount of oxygen in the exhaust gas produced by the internal combustion engine, and a preprogrammed electronic control unit for receiving a voltage signal from the oxygen sensor, and in response thereto producing fuel injector control signals controlling the operation of the fuel injectors, the apparatus comprising:

a voltage modifying means for proportionally modifying a reference voltage as a function of the voltage signal of the oxygen sensor to modify the fuel injector control signals produced by the electronic control unit without modifying the programming of the electronic control unit; and said voltage modifying means being interposable between the oxygen sensor and the electronic control unit.

2. The apparatus of claim 1, wherein said voltage modifying means modifies said reference voltage to cause the electronic control unit to produce fuel injector control signals that provide a richer fuel mixture to the internal combustion engine than what would be provided in the absence of said voltage modifying means.

3. The apparatus of claim 1, wherein said voltage modifying means passes through the voltage signal of the oxygen sensor to the electronic control unit without modification of the voltage signal.

4. The apparatus of claim 1, wherein said voltage modifying means includes a resistor circuit which passes through the voltage signal of the oxygen sensor to the electronic control unit without modification to the voltage signal, and divides the voltage signal of the oxygen sensor based upon the resistance values of a resistor pair and adds the divided voltage to said reference voltage.

5. The apparatus of claim 1, wherein said voltage modifying means increases said reference voltage.

6. The apparatus of claim 1, wherein said voltage modifying means includes a resistor circuit.

7. A method for adjusting the performance of an internal combustion engine of a motor vehicle including fuel injectors, an oxygen sensor for sensing the amount of oxygen in the exhaust gas produced by the internal combustion engine, and a preprogrammed electronic control unit for receiving a voltage signal from the oxygen sensor, and in response thereto producing fuel injector control signals controlling the operation of the fuel injectors, the method comprising the steps of:

interposing a voltage modifying means between the oxygen sensor and the preprogrammed electronic control unit;

passing voltage signals from the oxygen sensor to the preprogrammed electronic control unit without modification to the voltage signals;

proportionally modifying a reference voltage with said voltage modifying means as a function of the passed voltage signals from the oxygen sensor to produce a modified reference voltage;

generating modified fuel injector control signals as a function of said modified reference voltage without changing the programming of the preprogrammed electronic control unit; and employing said modified fuel injector control signals to cause the fuel injectors to provide a richer fuel mixture to the internal combustion engine than would be provided in the absence of the step of modifying the reference voltage.

8. An apparatus for modifying the performance of an internal combustion engine of a motor vehicle including fuel injectors, an exhaust gas sensor for sensing an amount of a constituent of the exhaust gas produced by the internal combustion engine, and a preprogrammed electronic control unit for receiving a voltage signal from the exhaust gas sensor, and in response thereto producing fuel injector control signals controlling the operation of the fuel injectors, the apparatus comprising:

a voltage modifying means for proportionally modifying a reference voltage as a function of the voltage signal of the exhaust gas sensor to modify the fuel injector control signals produced by the electronic control unit without modifying the programming of the electronic control unit; and said voltage modifying means being interposable between the exhaust gas sensor and the electronic control unit.

9. The apparatus of claim 8, wherein said exhaust gas sensor is an oxygen sensor for sensing the amount of oxygen in the exhaust gas.

10. The apparatus of claim 8, wherein said voltage modifying means modifies said reference voltage to cause the electronic control unit to produce fuel injector control signals that provide a richer fuel mixture to the internal combustion engine than what would be provided in the absence of said voltage modifying means.

11. The apparatus of claim 8, wherein said voltage modifying means passes through the voltage signal of the exhaust gas sensor to the electronic control unit without modification of the voltage signal.

12. The apparatus of claim 1, wherein said voltage modifying means includes a resistor circuit which passes through the voltage signal of the exhaust gas sensor to the electronic control unit without modification to the voltage signal, and divides the voltage signal of the exhaust gas sensor based upon the resistance values of a resistor pair and adds the divided voltage to said reference voltage.

13. The apparatus of claim 8, wherein said voltage modifying means increases said reference voltage.

14. The apparatus of claim 8, wherein said voltage modifying means includes a resistor circuit.

* * * * *